US006595771B2

(12) United States Patent
Chu

(10) Patent No.: US 6,595,771 B2
(45) Date of Patent: Jul. 22, 2003

(54) SAFETY CANDLEHOLDER

(76) Inventor: Yi-Hsueh Chu, No. 15, lane 93, ho Chiang St., Taipei (TW)

( * ) Notice: Subject to any disclaimer, the term of this patent is extended or adjusted under 35 U.S.C. 154(b) by 0 days.

(21) Appl. No.: 09/981,727

(22) Filed: Oct. 19, 2001

(65) Prior Publication Data

US 2002/0048739 A1 Apr. 25, 2002

(30) Foreign Application Priority Data

Oct. 20, 2000 (TW) ..... 89218183 U

(51) Int. Cl.[7] ..... F21V 35/00; F21V 37/02

(52) U.S. Cl. ..... 431/291; 362/161; 362/163; 362/180; 362/182; 362/181; 362/172; 362/173

(58) Field of Search ..... 431/289, 291, 431/86, 6, 18, 144, 145, 146, 147, 148, 149, 152; 362/161, 162, 163, 171–178, 180–182, 209, 266, 312–316, 409, 415, 447, 179; 126/42, 25 C

(56) References Cited

U.S. PATENT DOCUMENTS

| | | | | | |
|---|---|---|---|---|---|
| 8,732 | A | * | 2/1852 | Blaisdell et al. | 126/152 R |
| 65,229 | A | * | 5/1867 | Irwin | 362/171 |
| 194,466 | A | * | 8/1877 | Requa | 362/180 |
| 209,188 | A | * | 10/1878 | Npaull | 362/171 |
| 362,331 | A | * | 5/1887 | Taber | 362/161 |
| 424,776 | A | * | 4/1890 | Froh | 362/314 |
| 521,829 | A | * | 6/1894 | Stevens | 362/180 |
| 1,255,614 | A | * | 2/1918 | Knapp | 431/291 |
| 1,257,658 | A | * | 2/1918 | Will | 362/163 |
| 2,685,023 | A | * | 7/1954 | Valle | 362/163 |
| 4,186,430 | A | * | 1/1980 | Britton | 362/162 |
| 5,683,239 | A | * | 11/1997 | Cardosi | 431/291 |
| 5,688,040 | A | * | 11/1997 | Klees | 362/163 |
| 5,722,763 | A | * | 3/1998 | Chen | 362/163 |

FOREIGN PATENT DOCUMENTS

| | | | | |
|---|---|---|---|---|
| JP | 09-302998 | * | 11/1997 | 431/291 |

* cited by examiner

*Primary Examiner*—Carl D. Price
(74) *Attorney, Agent, or Firm*—Rosenberg, Klein & Lee

(57) ABSTRACT

A safety candleholder comprises a seat, a center of the seat having a hollow groove base; an outer side of the groove base being installed with an inner ring and an outer ring; inner walls of the inner ring and the outer ring being installed with inner thread portions; a plurality of via holes being formed at a bottom of the seat; the inner lampshade being installed with an opening; an outer side of the opening having a flange; a diameter of the opening being smaller than a diameter of the candle; and an outer lampshade screwedly fixed to the outer ring, thereby, an annular groove being formed between the two lampshade so that air can flow in the annular groove; an upper end of the outer lampshade having an opening; an outer side of the opening being installed with an annular flange, thus, a safety candleholder being formed.

11 Claims, 8 Drawing Sheets

SAFETY CANDLEHOLDER

BACKGROUND OF THE INVENTION

1. Field of the Invention

The present invention relates to a safety candleholder, and particularly to a candleholder having two lampshades for preventing wind from blowing out the fire of a candle.

2. Description of the Related Art

Candles are often used to provide a soothing effect upon people, with its warmly emitted light. Candleholders are necessary not only for supporting candles, but also for serving a decorative function themselves. A prior art candleholder typically has a seat onto which a candle is inserted. The seat is covered by a plastic or glass lampshade for improving indoor illumination. However, in prior art candleholders, only one layer of lampshade is used. After the candle burns over a certain time period, high temperatures may be generated to potentially cause an accident. Moreover, a wind or draft may blow upon the fire of the candle so that it is prematurely extinguished. Further, lampshades are generally made of glass or plastic; and, when the candleholder falls over, it is susceptible to breakage. Also, molten wax may flow outward in that event to induce an accident.

SUMMARY OF THE INVENTION

Accordingly, the primary object of the present invention is to provide a safety candleholder having two lampshades for preventing wind from blowing out the fire of a candle.

Another object of the present invention is to provide a candleholder in which the openings of the inner and outer lampshades are prevented from facing downward even if the candleholder were to fall over. Thereby, the molten wax of the candle in the safety candleholder is kept from flowing out of the safety candleholder to induce an accident.

To achieve the above objects, the present invention provides a safety candleholder, wherein an annular groove is formed between two lampshades for isolating heat and preventing the outer lampshade from being overheated.

BRIEF DESCRIPTION OF THE DRAWINGS

The various objects and advantages of the present invention will be more readily understood from the following detailed description when read in conjunction with the appended drawings, wherein.

DETAILED DESCRIPTION OF THE PREFERRED EMBODIMENTS

Figure 1:
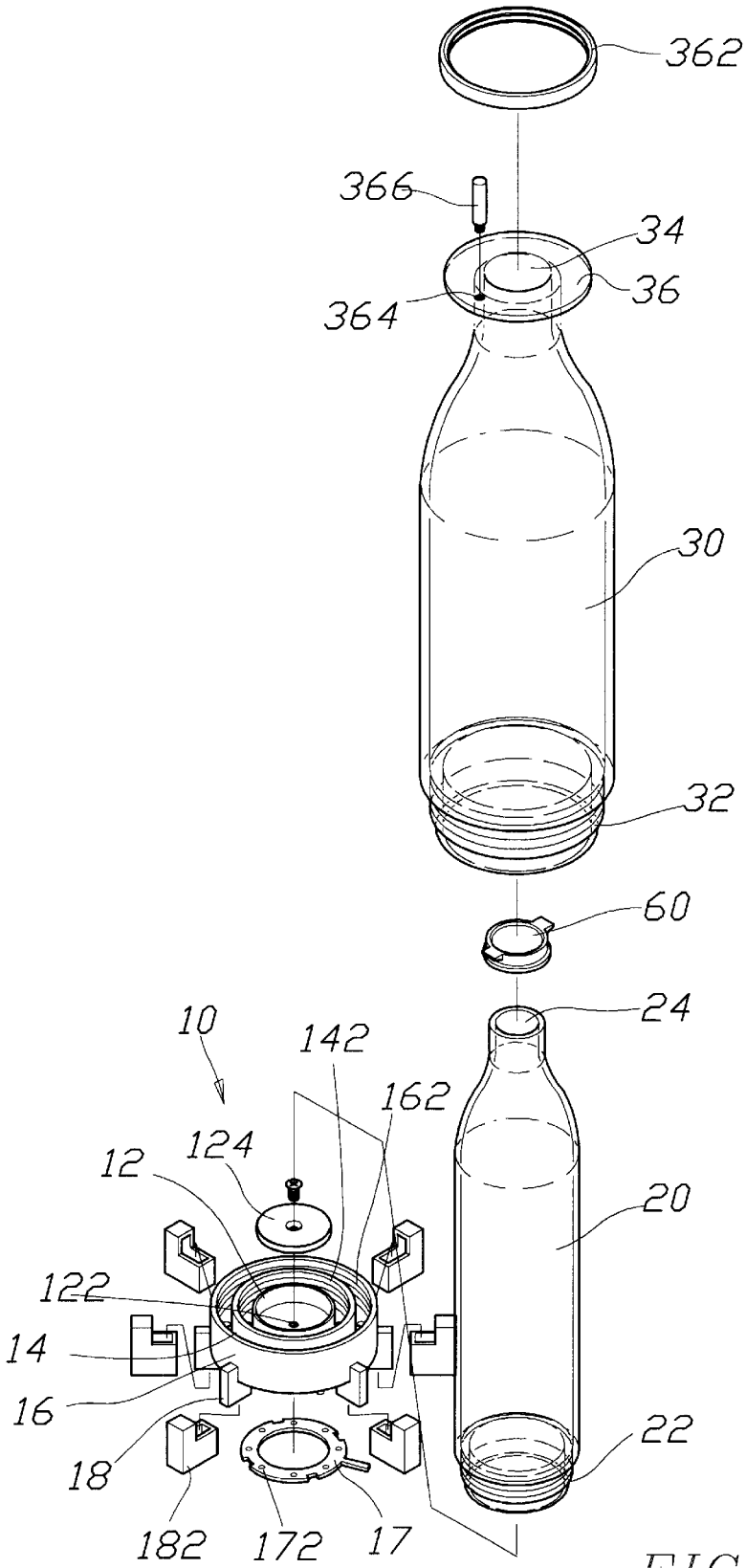
FIG. 1 is an exploded perspective view of one preferred embodiment of the present invention.
Figure 2:
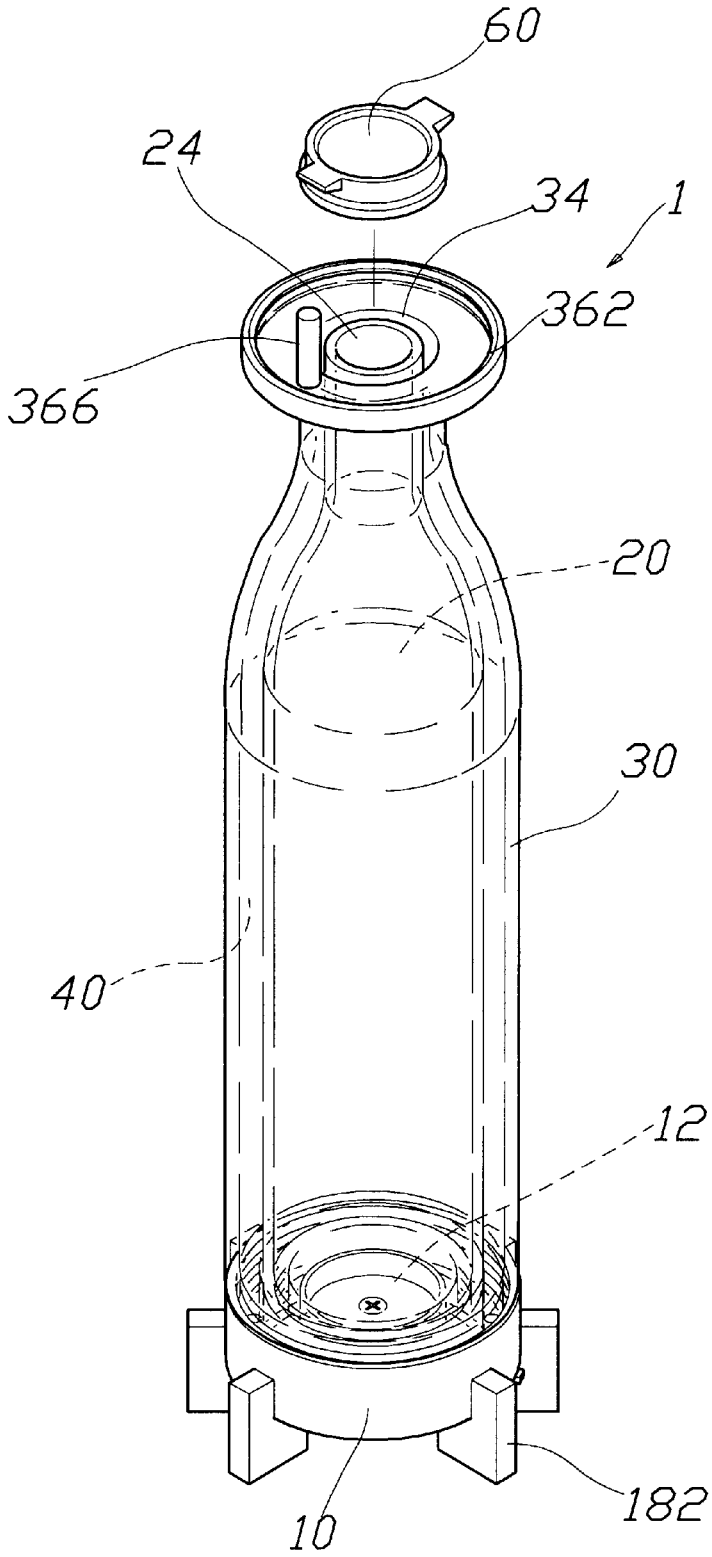
FIG. 2 is an assembled perspective view of the preferred embodiment of the present invention.

Referring to FIGS. 1 and 2, the safety candleholder 1 of the present invention is installed with a seat 10. At the center of the seat 10 is formed a hollow groove base 12. The groove base 12 is provided with a threaded hole 122 at its center, such that a magnet 124 may be threadedly secured to the groove base 12 by screws. About the groove base 12 is formed an inner ring 14 and an outer ring 16, whose inner walls are provided with inner threads 142, 162. A plurality of via holes 11, 13 (FIGS. 3–5A) are formed at the bottom of the seat 10 between the groove base 12 and the inner ring 14, and between the inner ring 14 and the outer ring 16 for the passage of air therethrough. Engaging the outer side of the outer ring 16 are a plurality of supporting pins 18 evenly distributed for steadily supporting the plane of the seat 10.

The bottom of the groove base 12 includes an annular fixed buckling seat 15 for being engaged by an annular adjusting piece 17 configured to extend between the groove base 12 and the inner ring 14. The adjusting piece 17 has formed therein a plurality of through holes 172 which correspond to the via holes 13. Therefore, when the annular adjusting piece 17 is rotated on the fixed buckling seat 15, as the position of its through holes 172 align with the via holes 13, air may flow through the via holes 13.

An inner lampshade 20 and a plastic-made outer lampshade 30 are threadedly coupled to the inner ring 14 and the outer ring 16, respectively. Each of the lower ends of the inner lampshade 20 and the outer lampshade 30 is formed with outer threads 22, 32 for engaging the respective inner threads 142, 162 of the inner and outer rings 14, 16. Once the lampshades are so coupled to the seat 10, an annular groove 40 is formed between the inner lampshade 20 and the outer lampshade 30.

Each of the upper ends of the inner lampshade 20 and the outer lampshade 30 is formed with an opening 24, 34. Extending about the opening 34 of the outer lampshade 30 is a flange 36. The diameter of the opening 24 of the inner lampshade 20 is configured to be smaller than the diameter of the candle installed on the groove base 12. A safety candleholder is thus formed.

Figure 3:
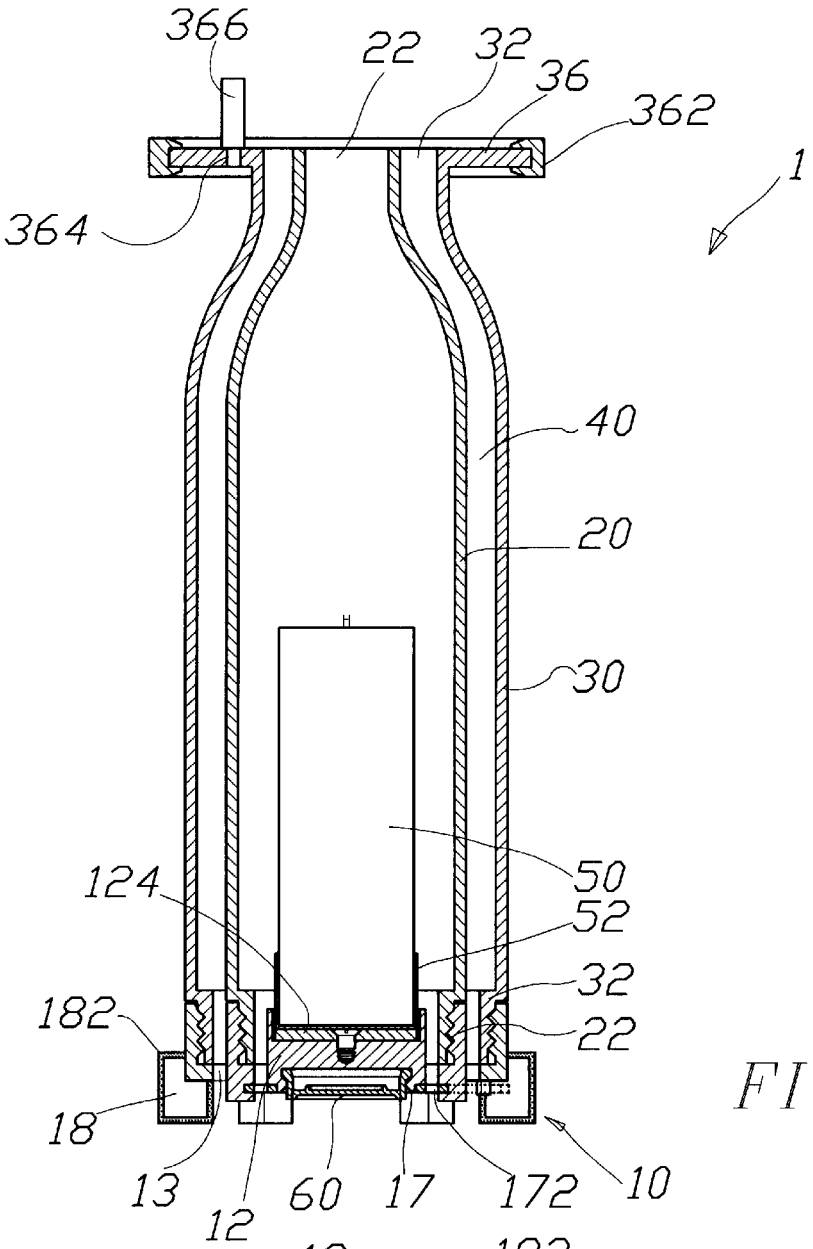
FIG. 3 is a lateral cross sectional view of the preferred embodiment of the present invention.
Figure 3A:
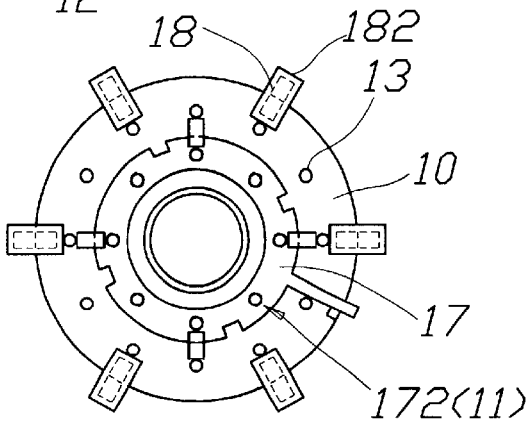
FIG. 3A is a plan view of the embodiment as shown in FIG. 3.
Figure 4:
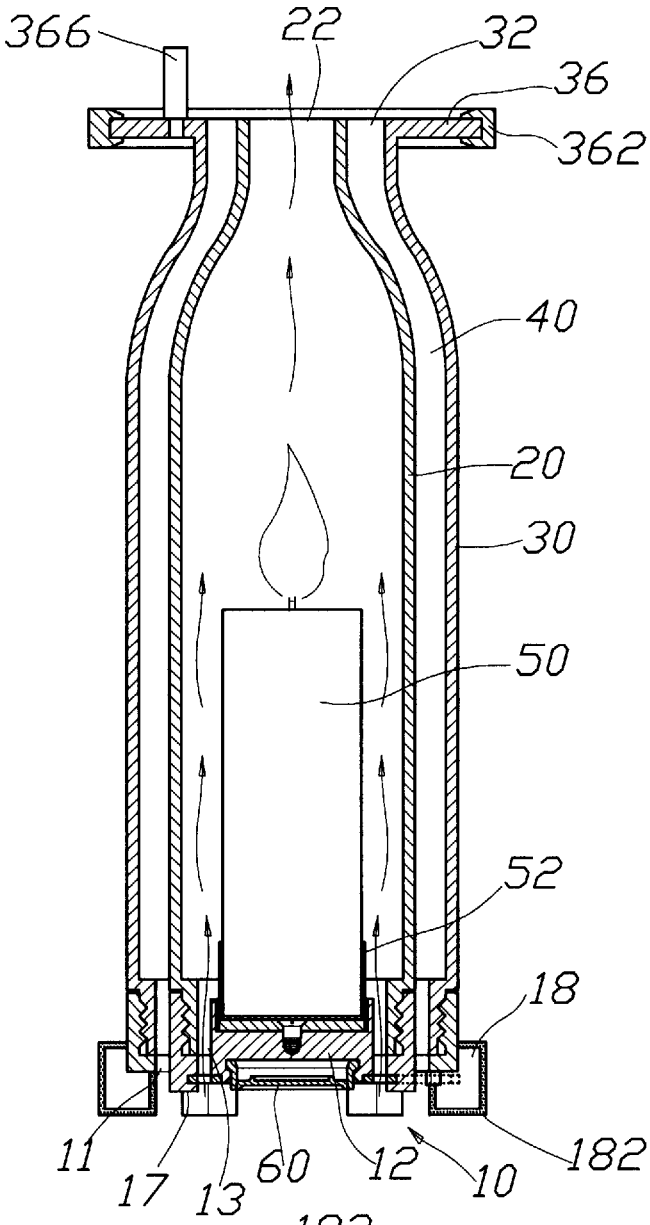
FIG. 4 is a lateral cross sectional view of the preferred embodiment of the present invention as it is used.
Figure 4A:
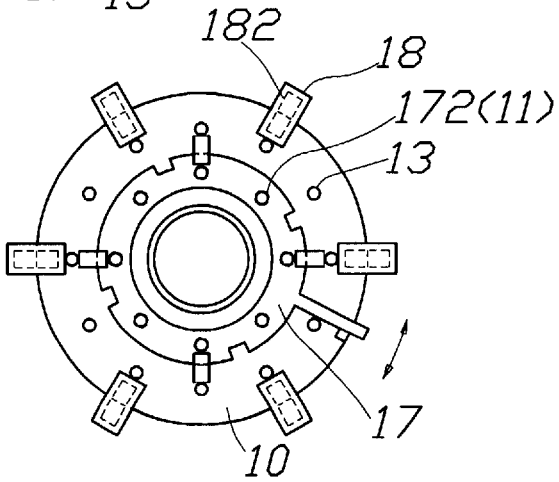
FIG. 4A is a plan view of the embodiment as shown in FIG. 4.

Referring to FIGS. 3 and 3A, when a candle 50 on a metal candle seat 52 is installed within the candleholder 1, it is fixed to the groove base 12 by the attraction of the magnet 124. The inner lampshade 20 and the outer lampshade 30 are sequentially threaded onto the inner ring 14 and the outer ring 16. Meanwhile, the annular adjusting piece 17 is rotated and adjusted, so that the position of the through holes 172 are aligned with the via holes 13. Thereby, as the candle 50 burns, the outer air may flow into the inner lampshade 20 from the lower side of the seat 10 through the via holes 13 to supply fresh air for maintaining the flame. Hot air is dispersed through the opening 24 at an upper end of the lampshade 20, as illustrated in FIGS. 4 and 4A.

Furthermore, when using the safety candleholder 1 of the present invention, the inner lampshade 20 and the outer lampshade 30 are spaced by a gap formed by the annular groove 40. A plurality of via holes 11 are formed on the seat 10 between the inner ring 14 and the outer ring 16 so that the air flows in the annular groove 40 between the inner lampshade 20 and the outer lampshade 30. The heat generated within the inner lampshade 20 may then disperse also through the opening 34 at the upper side of the outer lampshade 30. The generated heat is effectively kept from transferring to the surface of the outer lampshade 30. As a result, little heat is generated at the surface of the outer ring 16, and safety is preserved.

Figure 5:
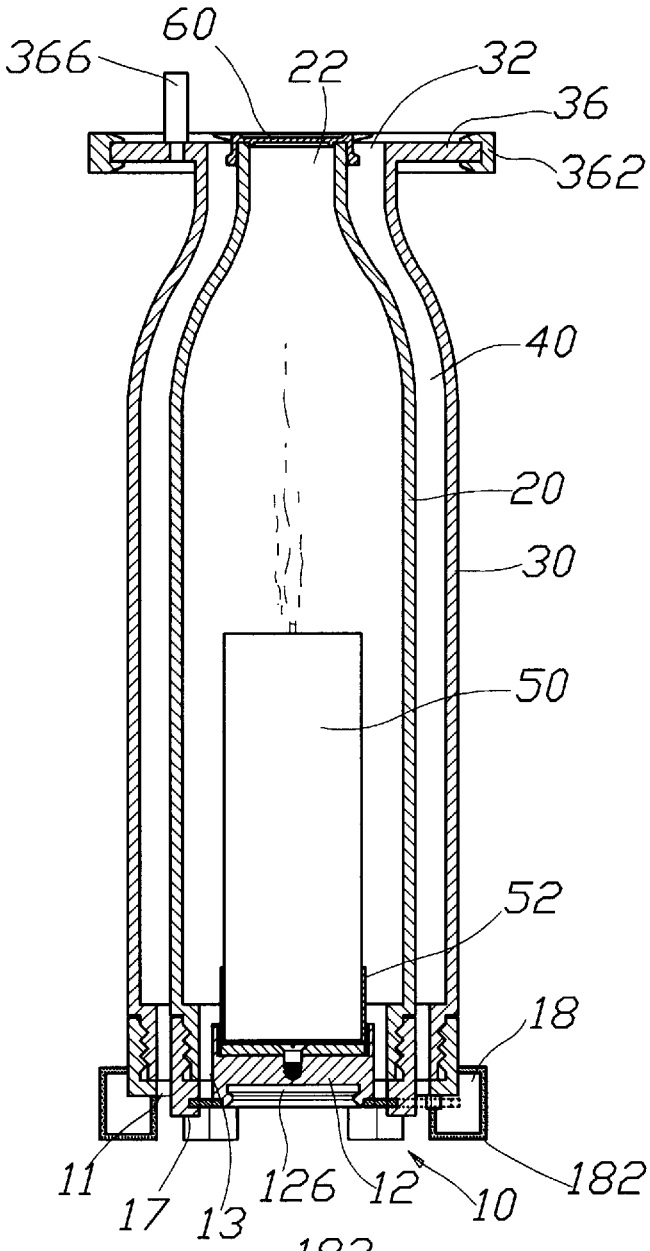
FIG. 5 is a lateral cross sectional view illustrating the fire of the candle being extinguished.
Figure 5A:
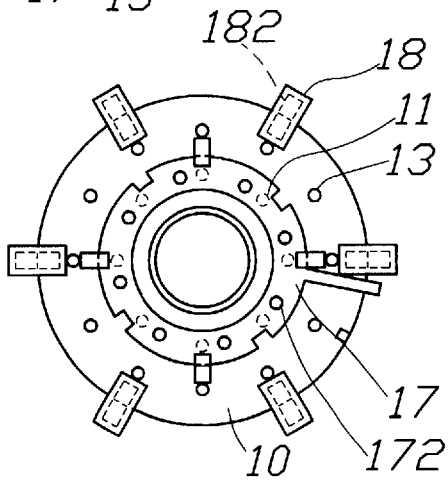
FIG. 5A is a plan view of the embodiment as shown in FIG. 5.

Referring to FIGS. 5 and 5A, when the candle flame within the safety candleholder 1 of the present invention is to be extinguished, a cover 60 is employed to cover the opening 24 at the upper end of the inner ring 14. Meanwhile the annular adjusting piece 17 is rotated so that the through holes 172 no longer align with the via holes 13. This causes the via holes 13 to be shielded and prevents air from flowing into the inner chamber defined by the inner lampshade 20. Therefore, the inner chamber of the inner lampshade 20 becomes sealed, and the flame of the candle 40 extinguishes due to a lack of oxygen. When not in use, the cover 60 may be secured to a groove 126 formed beneath the groove base 12, to be stowed thereat.

Moreover, to prevent breakage of the candleholder's lampshade when it falls over, the flange 36 and the supporting legs 18 are enclosed respectively by an elastic rubber ring 362 and elastic covers 182 which absorb shock. As a result, the inner lampshade 20 is protected from breakage if accidentally tipped over.

Figure 6:
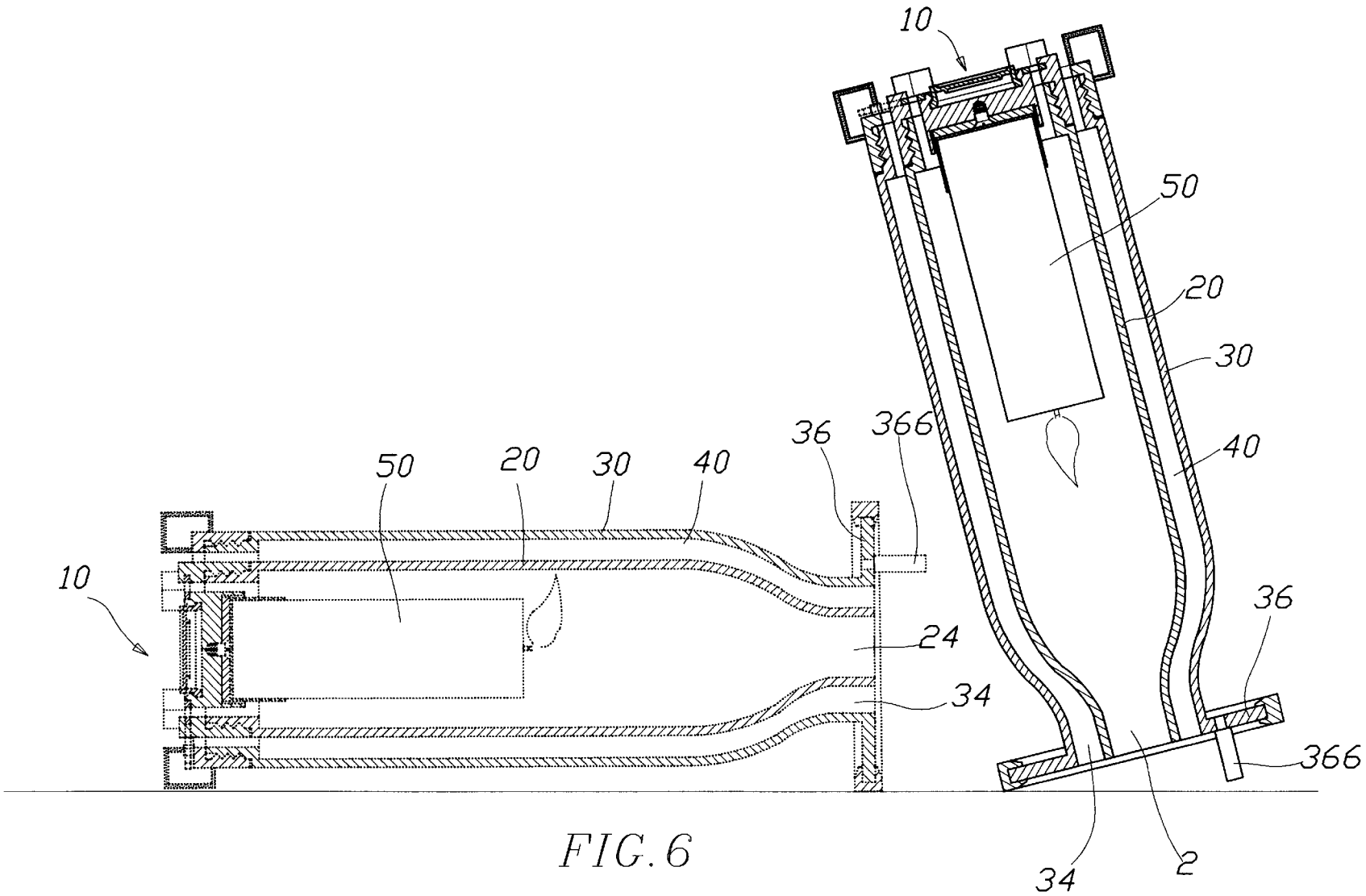
FIG. 6 is a schematic view illustrating the preferred embodiment of the present invention falling over.

Referring to FIG. 6, a serious hazard would result if the safety candleholder 1 were to fall so that the openings 22, 32 of the inner lampshade 20 and the outer lampshade 30 face down. The hot molten wax of the candle 40 in the safety candleholder 1 would potentially flow out of the safety candleholder 1 to cause injury or induce an accident. Hence, the flange of the outer lampshade 30 is formed with a fixing hole 364 to which rod 366 having a predetermined length is fixed. Thus, when the safety candleholder 1 falls down, the rod 366 prevents the safety candleholder 1 from assuming an inverted position. The rod 366 also causes the center of gravity of the safety candleholder 1 to move outward, biasing the candleholder 1 to, if anything, just lie on one lateral side. This keeps the molten wax of the candle 40 from flowing out and causing burns.

Figure 7:
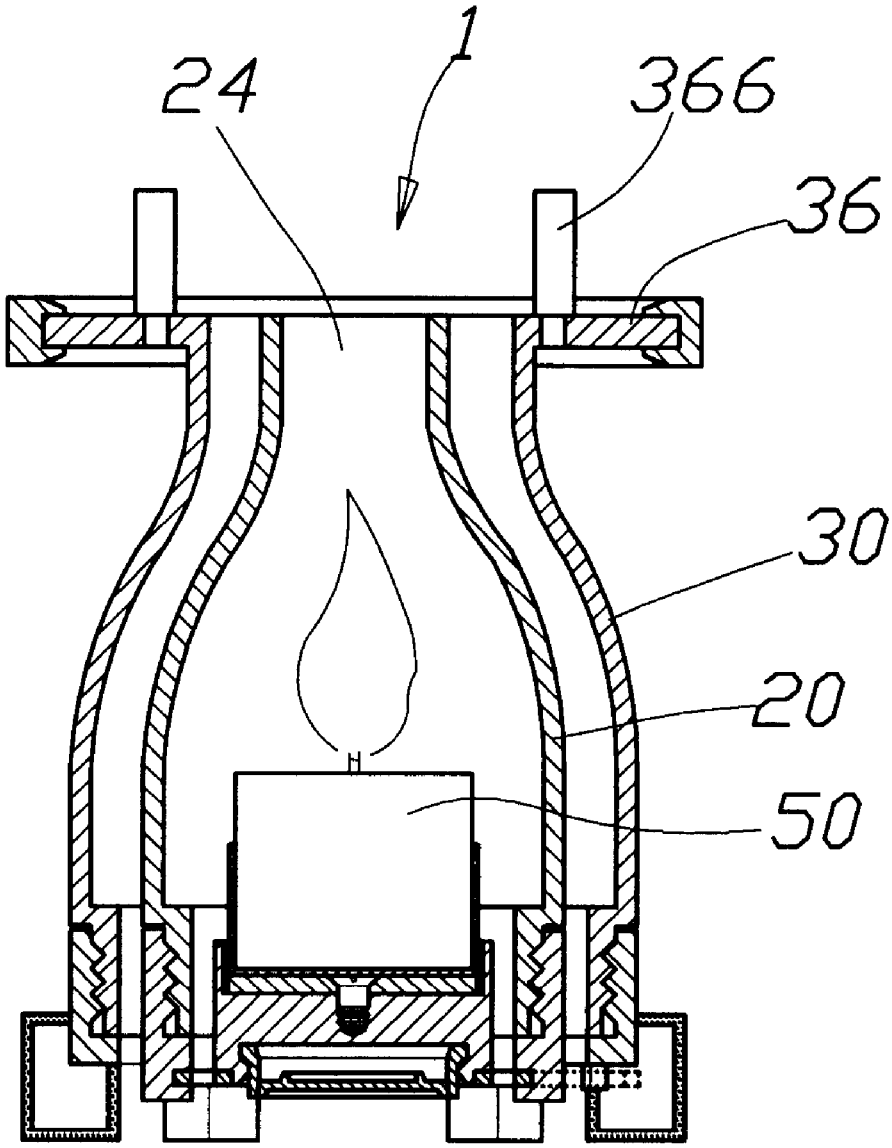
FIG. 7 shows an alternate embodiment of the present invention.

Referring to FIG. 7, another embodiment of the present invention is illustrated. In this embodiment, the lengths of the inner lampshade 20 and outer lampshade 30 are reduced. Thereby, when the candle 50 burns, it can be near the opening 24. Furthermore, the flange 36 is installed with at least three rods 366 which are annularly arranged in evenly spaced manner. Thus, objects to be heated can be supported by the rods 366 of the safety candleholder 1 above the flame of the candle 50.

Figure 8:
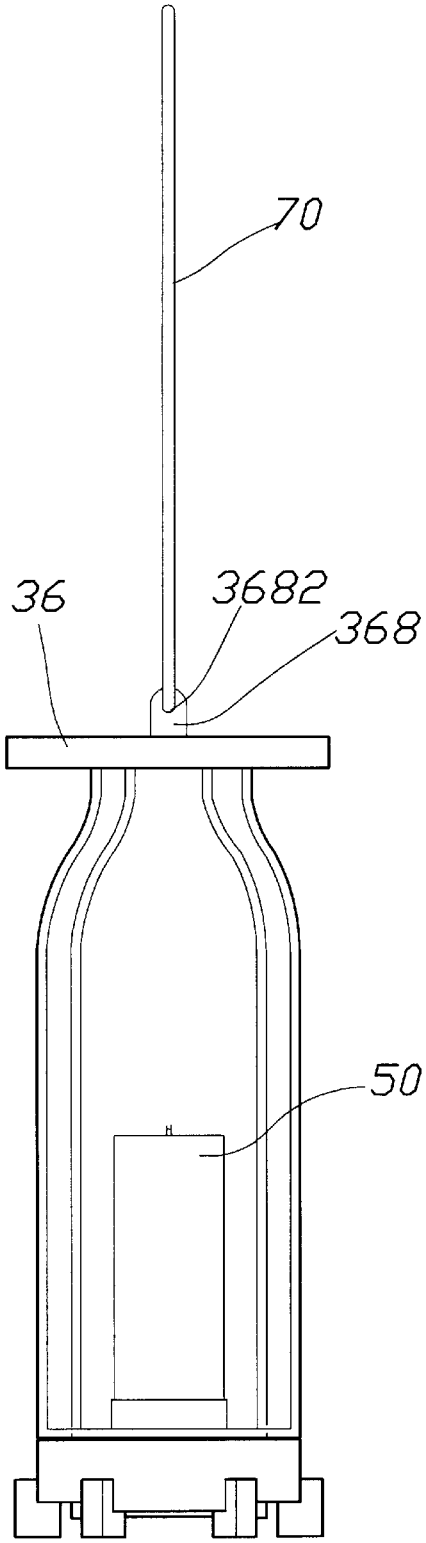
FIG. 8 shows yet another alternate embodiment of the present invention.
Figure 9:
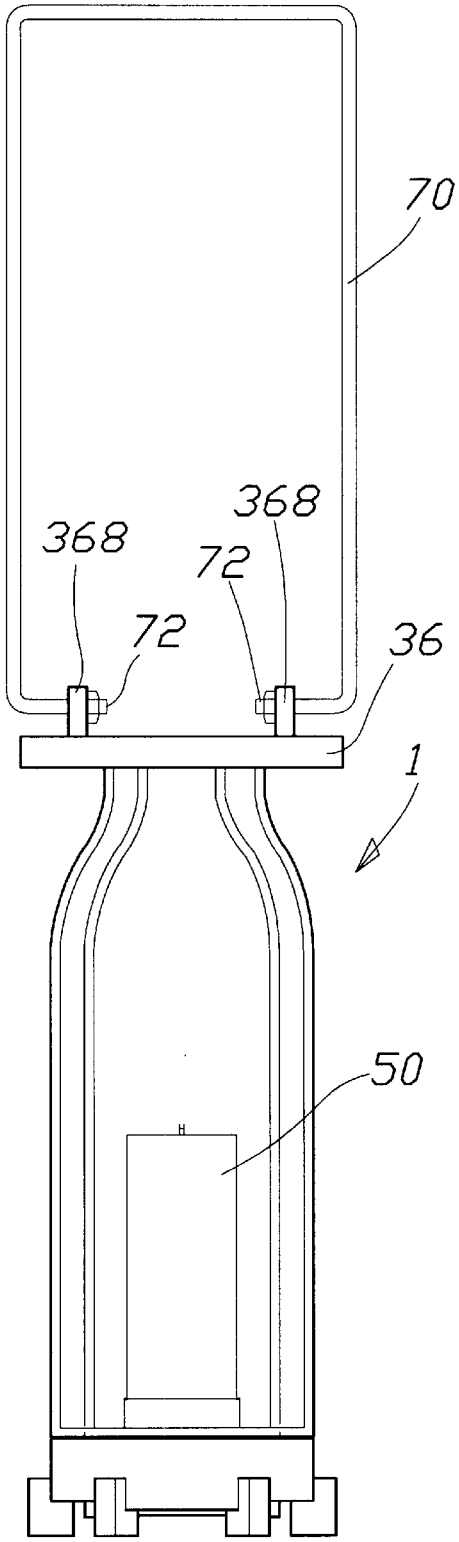
FIG. 9 is a lateral view of the embodiment as shown in FIG. 8.

Referring to FIGS. 8 and 9, a further embodiment of the present invention is illustrated. The safety candleholder 1 of the present invention can be installed with a handle 70, whereby the user may hold the safety candleholder 1. The handle 70 has an inverse U shape. Two ends thereof are bent to form pivotal portions 72. The flange 36 is correspondingly formed with pivotal seats 368 having pivotal holes 3682. The pivotal portions 72 are passed through the pivotal holes, and pivotally fixed therein by nuts.

Although the present invention has been described with references to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A safety candleholder for safely holding a candle comprising:

(a) a seat including:

a hollow base having a magnetic portion formed thereon;

inner and outer rings encircling said hollow base, each of said inner and outer rings having a threaded wall portion;

a bottom surface having a first portion extending between said hollow base and said inner ring, and a second portion extending between said inner ring and said outer ring, each of said first and second portions of said bottom surface having formed therein a plurality of through holes;

(b) an inner lampshade threadedly coupled to said inner ring, said inner lampshade defining an opening configured to obstruct the escape of the candle therethrough; and, (c) an outer lampshade threadedly coupled to said outer ring, said outer lampshade extending about said inner lampshade and be spaced therefrom by an annular groove, said outer lampshade having an opening and an annular flange extending outwardly therefrom.

2. The safety candleholder as recited in claim 1 wherein said seat further includes a plurality of supporting legs coupled to extend therefrom.

3. The safety candleholder as recited in claim 2 wherein said seat further includes a plurality of elastic covers for respectively enveloping said supporting legs.

4. The safety candleholder as recited in claim 1 wherein said seat further includes an annular adjusting piece coupled to said hollow base adjacent said first bottom surface portion, said annular adjusting piece being displaceable between open and closed positions relative to said first bottom surface portion, said annular adjusting piece having formed therein a plurality of through holes for communication with said through holes of said first bottom surface portion when in said open position.

5. The safety candleholder as recited in claim 1 further comprising a removable cover for said opening of said inner lampshade.

6. The safety candleholder as recited in claim 5 wherein said removable cover is detachably stowed beneath said hollow base.

7. The safety candleholder as recited in claim 1 wherein said outer lampshade includes an elastic ring substantially enveloping said annular flange.

8. The safety candleholder as recited in claim 1 wherein said outer lampshade includes a rod coupled to a fixing hole formed in said annular flange, said rod projecting upwardly from said annular flange for preventing inversion of said safety candleholder when tipped over.

9. The safety candleholder as recited in claim 1 wherein said hollow base has formed therein a fixing screw hole, said magnetic portion being secured by a screw fastener engaging said fixing screw hole.

10. The safety candleholder as recited in claim 1 wherein said inner and outer lampshades are dimensioned to maintain said openings thereof proximately positioned relative to an upper end of the candle, said outer lampshade including a plurality of rods coupled to project upwardly from said annular flange for supporting an object extending over said opening thereof.

11. The safety candleholder as recited in claim 1 further comprising a substantially U-shaped handle coupled to said outer lampshade, said handle having a pair of terminal ends pivotally engaging, respectively, a pair of pivotal seats formed on said annular flange.

* * * * *